US008477047B1

(12) United States Patent
Conrad et al.

(10) Patent No.: US 8,477,047 B1
(45) Date of Patent: Jul. 2, 2013

(54) SINGLE AUDIO CONTROL PANEL CONFIGURATION

(75) Inventors: Joel A. Conrad, Cedar Rapids, IA (US); Stephen R. Johnson, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 583 days.

(21) Appl. No.: 12/748,575

(22) Filed: Mar. 29, 2010

(51) Int. Cl.
*G08B 21/00* (2006.01)

(52) U.S. Cl.
USPC ..... 340/945; 340/963; 340/971; 701/9; 701/14

(58) Field of Classification Search
USPC .... 340/945, 963, 971; 701/3, 9, 14; 455/66.1, 455/73, 431; 381/58, 86, 94.1, 123
See application file for complete search history.

(56) References Cited

U.S. PATENT DOCUMENTS 8,264,376 B1 * 9/2012 McLoughlin et al. ..... 340/945
2003/0187552 A1 * 10/2003 Lehman et al. ..... 701/3
2006/0164261 A1 * 7/2006 Stiffler ..... 340/945
2008/0295090 A1 * 11/2008 Bestle et al. ..... 717/170
2009/0298451 A1 * 12/2009 Malaga et al. ..... 455/129
2011/0206211 A1 * 8/2011 Dahan et al. ..... 381/58

* cited by examiner

*Primary Examiner* — Brent Swarthout
(74) *Attorney, Agent, or Firm* — Donna P. Suchy; Daniel M. Barbieri

(57) ABSTRACT

The present invention is a communication system for implementation on-board an aircraft. The communication system includes an Audio Control Panel (ACP) including a first input device associated with an installed component and a second input device associated with an uninstalled component. The communication system further includes a Radio Interface Unit (RIU) which is communicatively coupled to the ACP. The communication system further includes an Engine Indicating and Crew Alerting System (EICAS) which includes a Display Management Computer (DMC), the EICAS being communicatively coupled to the RIU and an Aircraft Personality Module (APM) of the communication system. The DMC may be configured for evaluating an input device status (generated based upon an input received via the second input device) against an APM configuration file, and based upon said evaluation, providing an aural and/or visual alert to a user that an input device associated with an uninstalled component has been activated.

5 Claims, 3 Drawing Sheets

SINGLE AUDIO CONTROL PANEL CONFIGURATION

FIELD OF THE INVENTION

The present invention relates to the field of flight deck human machine interface (HMI) instrumentation and particularly to a single audio control panel configuration and method of operation of same.

BACKGROUND OF THE INVENTION

A number of currently available audio control panels (ACPs) for aircraft are created to align with a specific radio configuration of the aircraft in which said ACPs will be implemented. Because of the numerous radio configurations that customers select, this drove the need for management of multiple audio control panel configurations due to requirements that there be no dead buttons on the flight deck. Given the variety of radio configuration options being offered on today's airplanes, the number of possible audio control panel configurations which may need to be managed may become very large (ex.—25-30 possible audio control panel configurations), which presents a logistical problem.

Thus, it would be desirable to provide an audio control panel (ACP) solution which obviates the logistical problems associated with currently available ACP implementations.

SUMMARY OF THE INVENTION

Accordingly, an embodiment of the present invention is directed to a method of operation of a communication system, said method including: receiving a selecting input via an input device of a control panel of the communication system; in response to receiving said selecting input, providing a first signal from the control panel to an interface unit of the communication system; receiving the first signal at the interface unit and, based upon said received first signal, providing a first input device status signal from the interface unit to an alerting system of the communication system; providing a personality configuration file from a personality module of the communication system to the alerting system; receiving the first input device status signal and the personality configuration file at the alerting system; evaluating the first input device status signal against the personality configuration file; when said evaluating determines that the input device via which the selecting input was received is associated with an uninstalled component, providing an alert, the alert being at least one of: an aural alert provided via a speaker of the alerting system; and a visual alert provided via a display of the alerting system; receiving a de-selecting input via the input device of the control panel; in response to receiving said de-selecting input, providing a second signal from the control panel to the interface unit; receiving the second signal at the interface unit and, based upon said received second signal, providing a second input device status signal from the interface unit to the alerting system; receiving the second input device status signal at the alerting system; and in response to receiving said second input device status signal, at least one of: stopping the aural alert; and removing the visual alert.

An additional embodiment of the present invention is directed to a communication system, including: a control panel, the control panel including a plurality of input devices; an interface unit, the interface unit being communicatively coupled to the control panel; an alerting system, the alerting system including a management computer, the management computer being communicatively coupled to the interface unit; and a personality module, the personality module being communicatively coupled to the management computer, the personality module being configured for providing a personality module configuration file to the management computer, wherein a first input device included in the plurality of input devices is associated with a first component and a second input device included in the plurality of input devices is associated with a second component, the first component being an installed component, the second component being an uninstalled component.

A further embodiment of the present invention is directed to a communication system for implementation on-board an aircraft, said communication system including: an Audio Control Panel, the Audio Control Panel including a plurality of input devices; a Radio Interface Unit, the Radio Interface Unit being communicatively coupled to the Audio Control Panel; an Engine Indicating and Crew Alerting System, the Engine Indicating and Crew Alerting System including a Display Management Computer, the Display Management Computer being communicatively coupled to the Radio Interface Unit; and an Aircraft Personality Module, the Aircraft Personality Module being communicatively coupled to the Display Management Computer, the Aircraft Personality Module being configured for providing an Aircraft Personality Module configuration file to the Display Management Computer, wherein a first input device included in the plurality of input devices is associated with a first radio system and a second input device included in the plurality of input devices is associated with a second radio system, the first radio system being an installed radio system, the second radio system being an uninstalled radio system.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
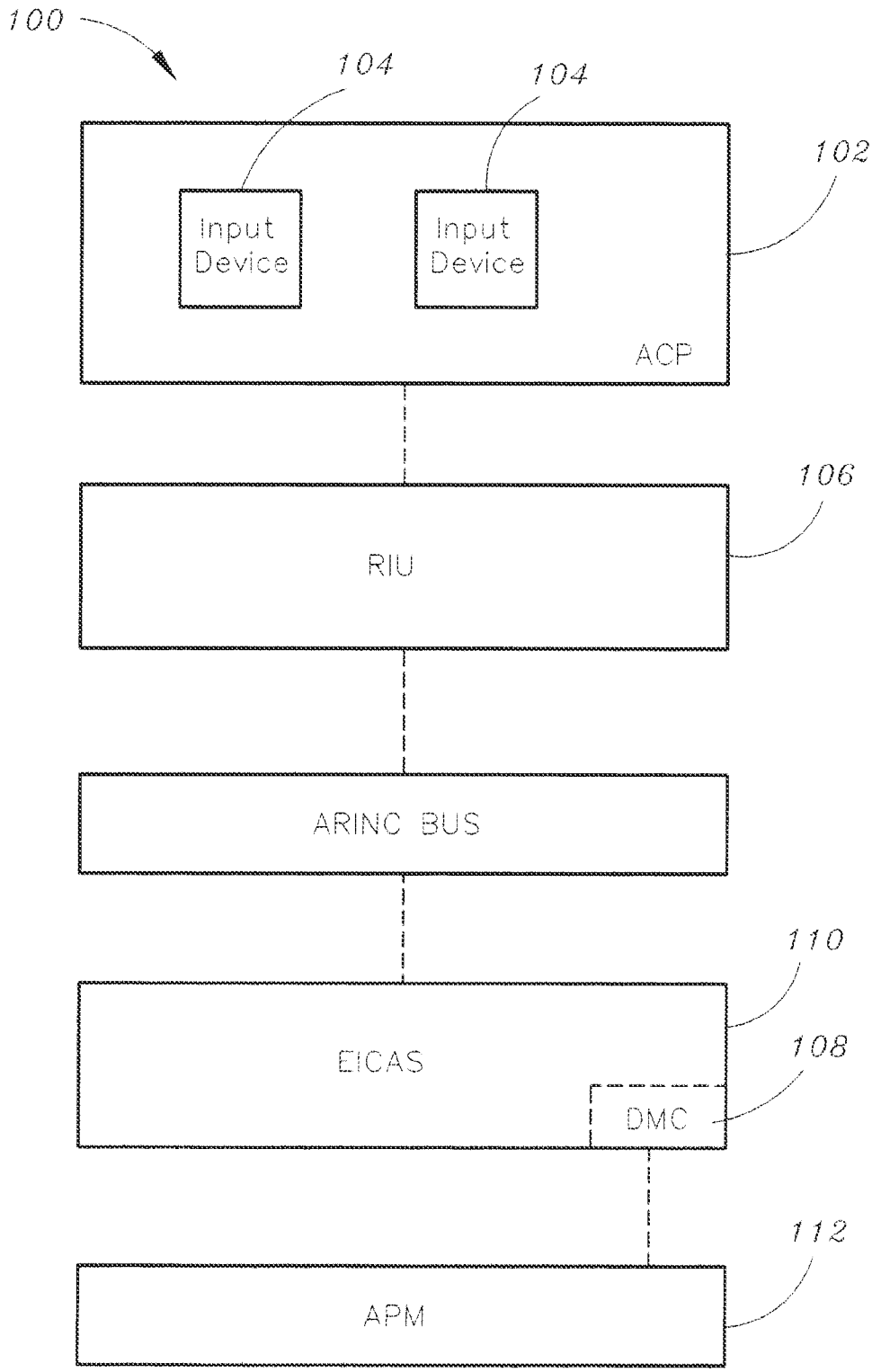
FIG. 1 is a block diagram schematic of a communication system in accordance with an exemplary embodiment of the present invention.

Referring to FIG. 1, a communication system 100 in accordance with an exemplary embodiment of the present invention is shown. In a current exemplary embodiment of the present invention, the communication system 100 may include a control panel 102. The control panel 102 may be configured for receiving one or more inputs (exs.—control input(s), setting(s), selection(s)) provided by a user via the control panel 102. For instance, the control panel 102 may include a plurality of input devices 104 (exs.—buttons, switches, knobs, or the like) for allowing a user to provide the control inputs via the control panel 102. In at least one embodiment of the present invention, the control panel 102 may be an Audio Control Panel (ACP) 102 configured for being installed and used on board an aircraft, such as in a flight deck system.

In exemplary embodiments of the present invention, one or more input devices 104 included in the plurality of input devices 104 may be associated with (exs.—may be connected to, may be configured for being placed into connection with, may be configured for selectively activating/deactivating, may be configured for providing an input to) equipment (ex.—a component) which is connected to the system 100 (ex.—installed upon the aircraft). In further embodiments of the present invention, the plurality of input devices 104 may further include one or more input devices 104 associated with equipment (ex.—components) which are not connected to the system 100 (exs.—not installed upon the aircraft, uninstalled equipment). In one embodiment of the present invention, the ACP 102 may include six input devices (exs.—a COM3 button, a HF1 button, a HF2 button, a SAT button, an ADF1 button and an ADF2 button) 104 associated with optional equipment (exs.—optional radios, optional radio systems) which may or may not be installed upon the aircraft upon which the system 100 is implemented. For instance, the COM3, HF1, SAT, ADF1 and ADF2 buttons 104 may be associated with (ex.—may be connected to) corresponding radio systems which are installed upon the aircraft upon which the system 100 is implemented, while the HF2 button 104 may be associated with a corresponding radio system which is not installed upon the aircraft upon which the system 100 is implemented (ex.—may not be connected to a corresponding radio system). Thus, the ACP 102 of the exemplary embodiments of the present invention, because of its various input devices 104, may be suitable for implementation on-board aircraft having any one of a variety of radio configurations (ex.—various combinations of radio systems installed).

In current exemplary embodiments of the present invention, the system 100 may further include an interface unit (ex.—a Radio Interface Unit (RIU)) 106. In further embodiments of the present invention, the RIU 106 may be configured for receiving one or more signals from the ACP 102. In exemplary embodiments of the present invention, when a user provides control inputs to the ACP 102 via the one or more input devices 104 of the ACP 102 (ex.—when the user presses one or more buttons 104 of the ACP 102), the ACP 102 may receive said control input(s) and the ACP 102 may provide one or more signals to the RIU 106 based upon the received input(s). In further embodiments of the present invention, the RIU 106 may be configured for receiving the signal(s) from the ACP 102. In still further embodiments of the present invention, the RIU 106, via RIU software executing on a processor of the RIU 106, may be configured for transmitting one or more input device status signals to a management computer (ex.—a Display Management Computer (DMC)) 108 of the system 100, said input device status signal(s) being based upon the received signal(s). In further embodiments, the RIU 106 may be communicatively coupled to the DMC 108 via a bus (ex.—an ARINC bus).

In exemplary embodiments of the present invention, the input device status signals may provide a status for each input device included in the plurality of input devices 104. For instance, a first input device status signal may indicate that a first input has been provided via a first input device included in the plurality of input devices 104 (exs.—the first input device status signal may indicate that the first input device has been pressed, switched on, selected, activated, established at a first setting, etc.), while a second input device status signal may indicate that a second input has been provided via a second input device included in the plurality of input devices 104 (exs.—the second input device status signal may indicate that the second input device has been switched off, de-selected, de-activated, established at a second setting, etc.).

In current exemplary embodiments of the present invention, the communication system 100 may include an alerting system 110 (ex.—an Engine Indicating and Crew Alerting System (EICAS)) 110. In exemplary embodiments of the present invention, the DMC 108 may be implemented as part of (ex.—may be included in or included as part of) the EICAS 110 and may include a processor and a memory, said processor and memory being communicatively coupled. In further embodiments of the present invention, the communication system 100 may further include a Personality Module 112 (ex.—an Aircraft Personality Module (APM) 112). In still further embodiments of the present invention, the APM 112 may be communicatively coupled to the DMC 108.

In exemplary embodiments of the present invention, the APM 112 is configured for providing an APM configuration file to the DMC 108. In further embodiments of the present invention, the APM configuration file may include installation information (ex.—information about which options, components, equipment, radio systems, etc. are installed upon the aircraft upon which the system 100 is implemented). In current exemplary embodiments of the present invention, the DMC 108 may be configured for receiving the APM configuration file from the APM 112. In further embodiments of the present invention, the DMC 108 may include logic configured for reading the APM configuration file. In still further embodiments of the present invention, the DMC 108 may be further configured for comparing the installation information of the APM configuration file to the input device status signal(s) received by the DMC 108.

In further embodiments of the present invention, based upon said comparison of the installation information of the APM configuration file to the input device status signals, determining if an input device 104 associated with equipment which is not installed upon the aircraft (ex.—uninstalled equipment) has been selected (ex.—activated). When comparison by the DMC 108 of the installation information to the input device status signal(s) indicates that an input device 104 associated with uninstalled equipment has been activated (ex.—selected), the DMC 108 may be further configured for generating a message. In further embodiments of the present invention, said generated message may be provided to a display of the EICAS 110 and displayed (ex.—as an advisory CAS message) via the display for providing a visual alert to let a viewer of the display (ex.—a flight crew member) know that an input device 104 associated with equipment which is uninstalled (ex.—not connected to that input device 104 and not installed on-board the aircraft upon which the system 100 is implemented) has been activated. For example, if the HF2 button 104 is pressed (ex.—selected, activated), but the HF2 button 104 is not associated with (ex.—not connected to) any radio system installed upon the aircraft in which the communication system 100 is implemented, an advisory CAS message saying "HF2 NOT INSTALLED" may appear on the display.

In further embodiments of the present invention, when comparison by the DMC 108 of the installation information to the input device status signal(s) indicates that an input device 104 associated with uninstalled equipment has been activated (ex.—selected), the DMC 108 may be further configured for causing the EICAS 110 to provide an aural alert (exs.—a single chime alert, a recorded voice message, or the like) to let a user of the EICAS 110 know that an input device 104 associated with equipment which is uninstalled (ex.—not connected to that input device 104 and not installed on-board the aircraft upon which the system 100 is implemented) has been activated. For example, the aural alert may be provided via a speaker of the EICAS 110. In still further embodiments, the aural alert and the visual alert may be provided concurrently via the EICAS 110.

In current exemplary embodiments of the present invention, at least one of the aural alert and the visual alert may continue to be provided until the input device 104 associated with the uninstalled equipment is de-selected or de-activated (ex.—in the case of a button, de-activation may be achieved by pressing the button again, in the case of a switch or knob, de-activation may be achieved by establishing the switch or knob at a different setting, etc.), such as by a flight crew member. In further embodiments of the present invention, when the DMC 108 receives an input device status signal which indicates that the input device associated with the uninstalled equipment has been de-selected or de-activated, the DMC 108 may be further configured for causing the EICAS 110 to remove, discontinue and/or halt the visual alert and/or the aural alert.

Figure 2A:
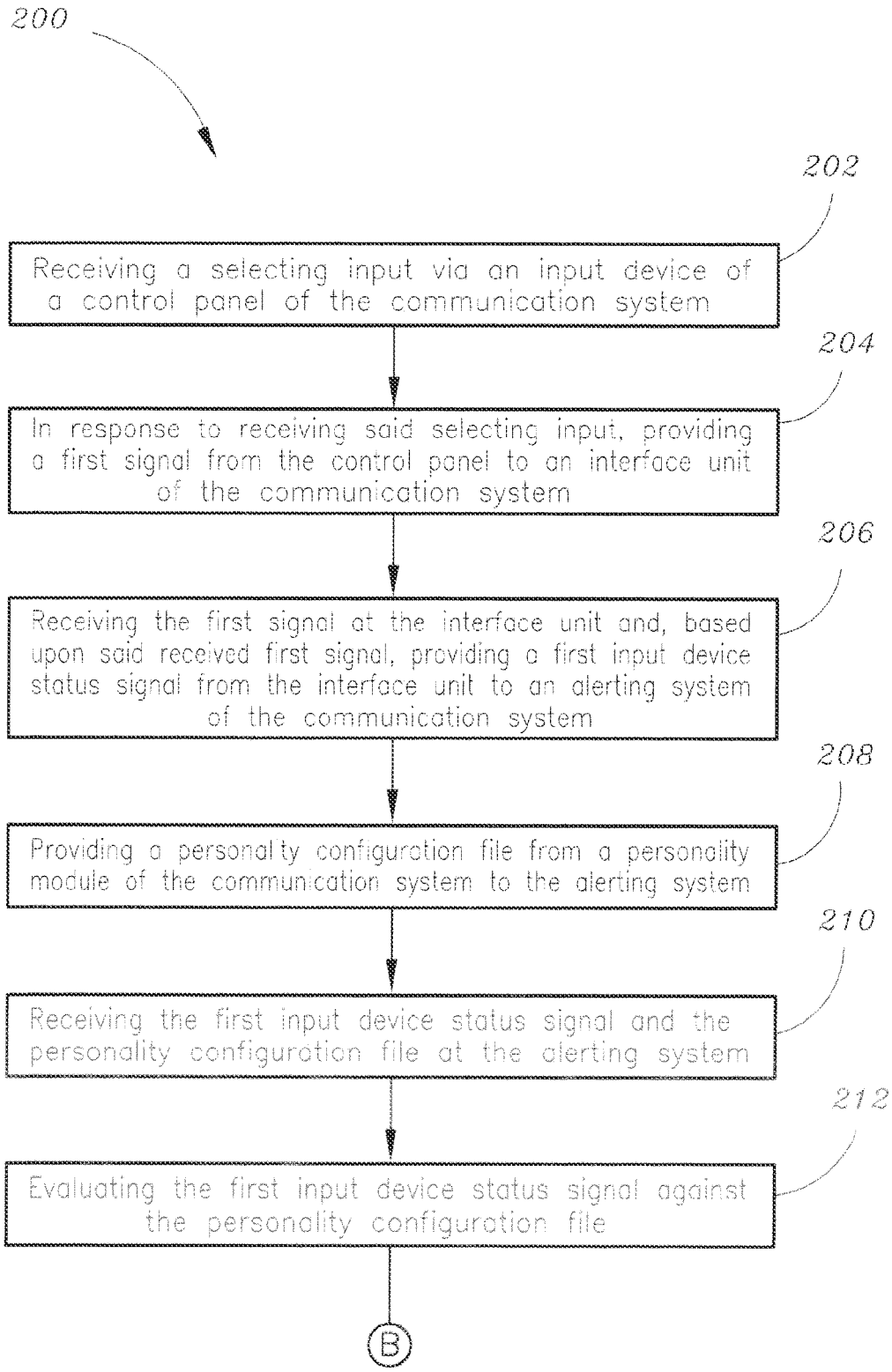
FIGS. 2A and 2B depict a flowchart illustrating a method of operation of a communication system, such as the communication system depicted in FIG. 1 in accordance with an exemplary embodiment of the present invention.
Figure 2B:
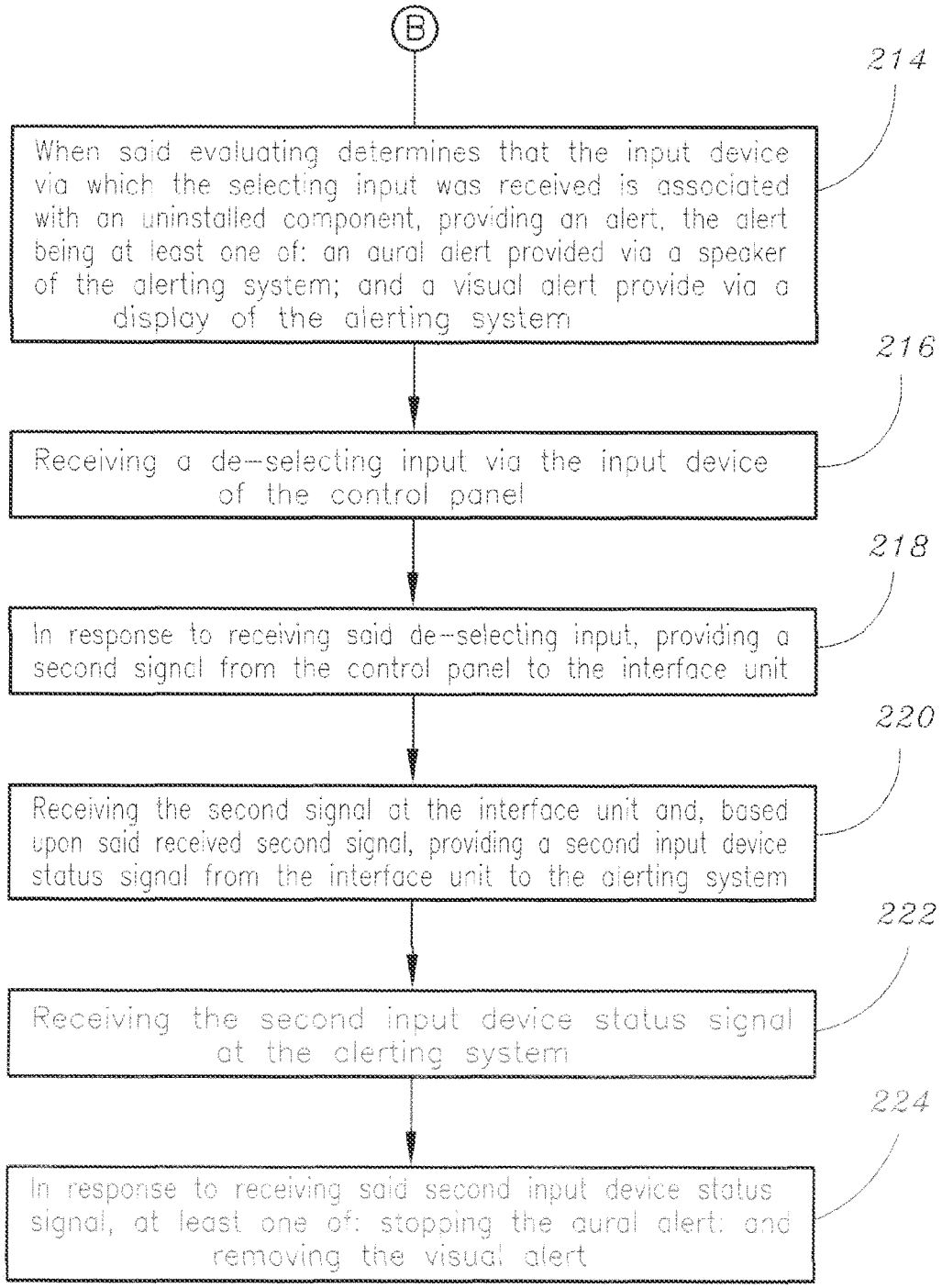

Referring generally to FIGS. 2A and 2B, a flowchart illustrating a method of operation of the communication system 100 of the present invention in accordance with an exemplary embodiment of the present invention is shown. The method 200 may include the step of receiving a selecting input via an input device of a control panel of the communication system 202. The method 200 may further include the step of, in response to receiving said selecting input, providing a first signal from the control panel to an interface unit of the communication system 204. The method 200 may further include the step of receiving the first signal at the interface unit and, based upon said received first signal, providing a first input device status signal from the interface unit to an alerting system of the communication system 206. The method 200 may further include the step of providing a personality configuration file from a personality module of the communication system to the alerting system 208.

In further embodiments of the present invention, the method 200 may further include the step of receiving the first input device status signal and the personality configuration file at the alerting system 210. The method 200 may further include the step of evaluating the first input device status signal against the personality configuration file 212. The method 200 may further include the step of, when said evaluating determines that the input device via which the selecting input was received is associated with an uninstalled component, providing an alert, the alert being at least one of: an aural alert provided via a speaker of the alerting system; and a visual alert provided via a display of the alerting system 214. The method 200 may further include the step of receiving a de-selecting input via the input device of the control panel 216. The method 200 may further include the step of, in response to receiving said de-selecting input, providing a second signal from the control panel to the interface unit 218. The method 200 may further include the step of receiving the second signal at the interface unit and, based upon said received second signal, providing a second input device status signal from the interface unit to the alerting system 220. The method 200 may further include the step of receiving the second input device status signal at the alerting system 222. The method 200 may further include the step of, in response to receiving said second input device status signal, at least one of: stopping the aural alert; and removing the visual alert 224.

It is understood that the specific order or hierarchy of steps in the foregoing disclosed methods are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented.

It is to be noted that the foregoing described embodiments according to the present invention may be conveniently implemented using conventional general purpose digital computers programmed according to the teachings of the present specification, as will be apparent to those skilled in the computer art. Appropriate software coding may readily be prepared by skilled programmers based on the teachings of the present disclosure, as will be apparent to those skilled in the software art.

It is to be understood that the present invention may be conveniently implemented in forms of a software package. Such a software package may be a computer program product which employs a computer-readable storage medium including stored computer code which is used to program a computer to perform the disclosed function and process of the present invention. The computer-readable medium may include, but is not limited to, any type of conventional floppy disk, optical disk, CD-ROM, magnetic disk, hard disk drive, magneto-optical disk, ROM, RAM, EPROM, EEPROM, magnetic or optical card, or any other suitable media for storing electronic instructions.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A communication system, comprising:

a control panel, the control panel including a plurality of input devices, a first input device included in the plurality of input devices associated with a first component and a second input device included in the plurality of input devices associated with a second component, the first component being an installed component, the second component being an uninstalled component;

an interface unit, the interface unit communicatively coupled to the control panel;

an alerting system, the alerting system including a management computer, the management computer communicatively coupled to the interface unit; and an Aircraft Personality Module, the Aircraft Personality Module communicatively coupled to the management computer, the Aircraft Personality Module configured for providing a personality module configuration file to the management computer, wherein the control panel is configured for providing a first signal to the interface unit when a first input is provided via the second input device, the interface unit is configured for receiving the first signal and providing a first input device status signal to the management computer, the first input device status signal being based upon the first signal, the management computer is configured for comparing the first input device status signal to the Aircraft Personality Module configuration file, and the alerting system is configured for providing, based upon said comparison by the management computer, at least one of: an aural alert; and a visual alert to a user of said communication system.

2. A communication system for implementation on-board an aircraft, said communication system comprising:

an Audio Control Panel, the Audio Control Panel including a plurality of input devices, a first input device included in the plurality of input devices associated with a first radio system and a second input device included in the plurality of input devices associated with a second radio system, the first radio system being an installed radio system, the second radio system being an uninstalled radio system;

a Radio Interface Unit, the Radio Interface Unit being communicatively coupled to the Audio Control Panel;

an Engine Indicating and Crew Alerting System, the Engine Indicating and Crew Alerting System including a Display Management Computer, the Display Management Computer being communicatively coupled to the Radio Interface Unit; and an Aircraft Personality Module, the Aircraft Personality Module being communicatively coupled to the Display Management Computer, the Aircraft Personality Module being configured for providing an Aircraft Personality Module configuration file to the Display Management Computer, wherein the Audio Control Panel is configured for providing a first signal to the Radio Interface Unit when a first input is provided via the second input device, the Radio Interface Unit is configured for receiving the first signal and providing a first input device status signal to the Display Management Computer, the first input device status signal being based upon the first signal, the Display Management Computer is configured for comparing the first input device status signal to the Aircraft Personality Module configuration file, and the Engine Indicating and Crew Alerting System is configured for providing, based upon said comparison by the Display Management Computer, at least one of: an aural alert via a speaker of the Engine Indicating and Crew Alerting System; and a visual alert via a display of the Engine Indicating and Crew Alerting System.

3. A method of operation of a communication system, said method comprising:

receiving a selecting input via an input device of a control panel of the communication system;

in response to receiving said selecting input, providing a first signal from the control panel to an interface unit of the communication system;

receiving the first signal at the interface unit and, based upon said received first signal, providing a first input device status signal from the interface unit to an alerting system of the communication system;

providing a personality configuration file from a personality module of the communication system to the alerting system;

receiving the first input device status signal and the personality configuration file at the alerting system;

evaluating the first input device status signal against the personality configuration file; and when said evaluating determines that the input device via which the selecting input was received is associated with an uninstalled component, providing an alert, the alert being at least one of: an aural alert provided via a speaker of the alerting system; and a visual alert provided via a display of the alerting system.

4. A method as claimed in claim 3, further comprising:

receiving a de-selecting input via the input device of the control panel;

in response to receiving said de-selecting input, providing a second signal from the control panel to the interface unit; and receiving the second signal at the interface unit and, based upon said received second signal, providing a second input device status signal from the interface unit to the alerting system.

5. A method as claimed in claim 4, further comprising:

receiving the second input device status signal at the alerting system; and in response to receiving said second input device status signal, at least one of: stopping the aural alert; and removing the visual alert.

* * * * *